US005807463A

United States Patent [19]

Boughton

[11] Patent Number: 5,807,463

[45] Date of Patent: Sep. 15, 1998

[54] MAILING MACHINE INCLUDING A MOISTENER SYSTEM

[75] Inventor: Richard D. Boughton, Newtown, Conn.

[73] Assignee: Pitney Bowes Inc., Stamford, Conn.

[21] Appl. No.: 978,495

[22] Filed: Nov. 25, 1997

[51] Int. Cl.[6] ..... B43M 5/00

[52] U.S. Cl. ..... 156/441.5; 156/578

[58] Field of Search ..... 156/441.5, 442, 156/442.1, 442.2, 442.4, 578; 118/401, 415, 694

[56] References Cited

U.S. PATENT DOCUMENTS

| | | | |
|---|---|---|---|
| 749,377 | 1/1904 | Harte et al. | 156/442.1 |
| 1,894,427 | 1/1933 | Ryan | 118/401 |
| 2,077,780 | 4/1937 | Storck | 118/401 |
| 3,566,904 | 3/1971 | Davis | 137/206 |
| 3,905,325 | 9/1975 | Labore et al. | 118/7 |
| 4,038,941 | 8/1977 | Swaniger et al. | 118/243 |
| 4,450,037 | 5/1984 | Gavronsky | 156/441.5 |
| 4,643,123 | 2/1987 | Auerbach | 118/32 |
| 4,842,724 | 6/1989 | Bray et al. | 210/104 |
| 4,873,941 | 10/1989 | O'Dea | 118/669 |
| 4,948,453 | 8/1990 | Nobile et al. | 156/441.5 |
| 5,006,233 | 4/1991 | Mulsener | 210/96.1 |
| 5,034,123 | 7/1991 | Tanaka et al. | 210/195.1 |
| 5,145,709 | 9/1992 | Bergman | 427/8 |
| 5,209,806 | 5/1993 | Hibberd | 456/441.5 |
| 5,252,353 | 10/1993 | DiBiulio et al. | 427/9 |
| 5,309,938 | 5/1994 | Ellgoth et al. | 137/334 |
| 5,326,587 | 7/1994 | Bergman | 427/8 |
| 5,354,407 | 10/1994 | Hubbard et al. | 156/442.1 |
| 5,385,627 | 1/1995 | Weimer | 156/441.5 |
| 5,525,185 | 6/1996 | Holbrook et al. | 156/441.5 |
| 5,569,327 | 10/1996 | Paradis et al. | 118/253 |
| 5,674,348 | 10/1997 | DeFiguerido et al. | 156/441.5 |

*Primary Examiner*—James Sells
*Attorney, Agent, or Firm*—Angelo N. Chaclas; Melvin J. Scolnick

[57] ABSTRACT

An envelope handling device including a moistener module where the moistener module includes a reservoir assembly, a first well tank and a second well tank. The reservoir assembly includes a reservoir tank for holding a supply of reservoir water having a predetermined height; a first well tank for holding a supply of first well water, the first well tank directly coupled to the reservoir tank via a first well tank hose so that the reservoir water is capable of flowing through the first well tank hose to the first well tank and raising the first well water to the predetermined height; and a second well tank for holding a supply of second well water at a different height from the predetermined height, the second well tank coupled to the reservoir tank via a second well tank hose and a trap, the trap establishes a pressure differential between the predetermined height and a level of water within the trap; and wherein the reservoir water is capable of flowing through the second well tank hose and the trap to the second well tank and raising the second well water to the different height as air is captured within the trap to balance the pressure differential.

3 Claims, 1 Drawing Sheet

MAILING MACHINE INCLUDING A MOISTENER SYSTEM

FIELD OF THE INVENTION

This invention relates to an envelope handling device, such as a mailing machine, including a moistener system. More particularly, this invention is directed to a moistener system having a first water well at a first elevation and a second water well at a second elevation both of which are fed from a single water supply.

BACKGROUND OF THE INVENTION

Mailing machines are well known in the art. Generally, mailing machines are readily available from manufacturers such as Pitney Bowes Inc. of Stamford, Conn. Mailing machines often include a variety of different modules or sub-systems that automate the processes of producing mailpieces where each module performs a different task on the mailpiece. The typical mailing machine includes the following modules: singulator (separating the mailpieces one at a time from a stack of mailpieces), scale, moistener (wetting and sealing the gummed flap of an envelope or tape), printer (applying evidence of postage), meter (accounting for postage used) and stacker (stacking finished mailpieces). However, the exact configuration of each mailing machine is particular to the needs of the user. Customarily, the mailing machine also includes a transport apparatus that feeds the mailpieces in a path of travel through the successive modules of the mailing machine.

In some mailing machines it is desirable to print postal indicia on both envelopes and tapes. The tapes being used when the package or envelope to be mailed is oversized or too large to be fed through the mailing machine. Thus, the postal indicia is printed on a tape and then the tape is adhered to the oversized item. As a result, the moistener module is required to wet both envelope flaps and tapes.

Generally, all moistener modules include an applicator assembly for applying water to the envelope flap or the tape, as the case may be. A wide variety of applicator assemblies are known such as those employing moistening belts, pads, brushes and the like as described in the following U.S. Pat. Nos.: 3,905,325; 4,038,941; 4,450,037; 4,643,123; 5,209,806; 5,354,407, 5,525,185; 5,569,327 and 5,674,348. Typically, the applicator assembly is operatively coupled to a local water supply or well from which the applicator assembly draws water usually through some form of wicking or capillary action. In turn, the well is supplied by a remotely located water reservoir that the operator may replenish as needed. In this manner, the applicator assembly remains properly saturated as water is transferred to the envelope.

Although such prior art systems work generally well, they suffer from certain complications when it is desirable to employ a dual applicator assembly system having a first well and applicator for moistening envelopes and a second well and applicator spaced apart from the first well and applicator for moistening tapes. Thus, it is necessary to keep two wells supplied with water. This dual applicator assembly is further complicated when it is desirable to supply the two wells from a single reservoir. Still another complication occurs when the two wells are required to be maintained at different elevations as may be required by the differences between moistening envelopes and tapes and/or the changes in elevation dictated by a feed deck that is inclined from horizontal to assist in aligning the top edge of the envelopes along a registration wall as they are fed through the mailing machine.

Those skilled in the art will recognized that an active system for maintaining the two wells from a single reservoir may be employed through appropriate use of pumps, water level detection sensors, shutoff valves (i.e. solenoid operated) and the like. Although such an active system may be simple to implement, it suffers from certain drawbacks. As examples, the use of these devices increases the cost, space requirements and power requirements of the overall moistener module.

On the other hand, those skilled in the art will recognized that a passive system for maintaining the two wells may be employed through appropriate use of separate reservoirs for feeding each of the two wells, respectively. Although such a passive system may also be simple to implement, it too suffers from certain drawbacks. As examples, the use of two separate reservoirs increases the cost and space requirements of the overall moistener module as well as doubling the amount of operator intervention required. The operator must now check and maintain two reservoirs.

Therefore, there is a need for a moistener module that utilizes a passive system for supplying two wells at different elevations from a single reservoir. In this way, the drawbacks associated with the systems described above may be overcome in a cost effective manner without increasing the amount of operator intervention required.

SUMMARY OF THE INVENTION

The present invention provides a cost effective moistener module for passively supplying two water wells with water where the two water wells are at different elevations.

In conventional fashion, this invention may be incorporated into a variety of envelope handling devices requiring a moistener module, such as: a postage meter, a mailing machine, an inserter or other general purpose envelope handling device.

In accordance with the present invention, there is provided an envelope handling device including a moistener module where the moistener module includes a reservoir assembly, a first well tank and a second well tank. The reservoir assembly includes a reservoir tank for holding a supply of reservoir water having a predetermined height; a first well tank for holding a supply of first well water, the first well tank directly coupled to the reservoir tank via a first well tank hose so that the reservoir water is capable of flowing through the first well tank hose to the first well tank and raising the first well water to the predetermined height; and a second well tank for holding a supply of second well water at a different height from the predetermined height, the second well tank coupled to the reservoir tank via a second well tank hose and a trap, the trap establishes a pressure differential between the predetermined height and a level of water within the trap; and wherein the reservoir water is capable of flowing through the second well tank hose and the trap to the second well tank and raising the second well water to the different height as air is captured within the trap to balance the pressure differential.

Therefore, it is now apparent that the present invention substantially overcomes the disadvantages associated with the prior art. Additional advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENTS

Figure 1:
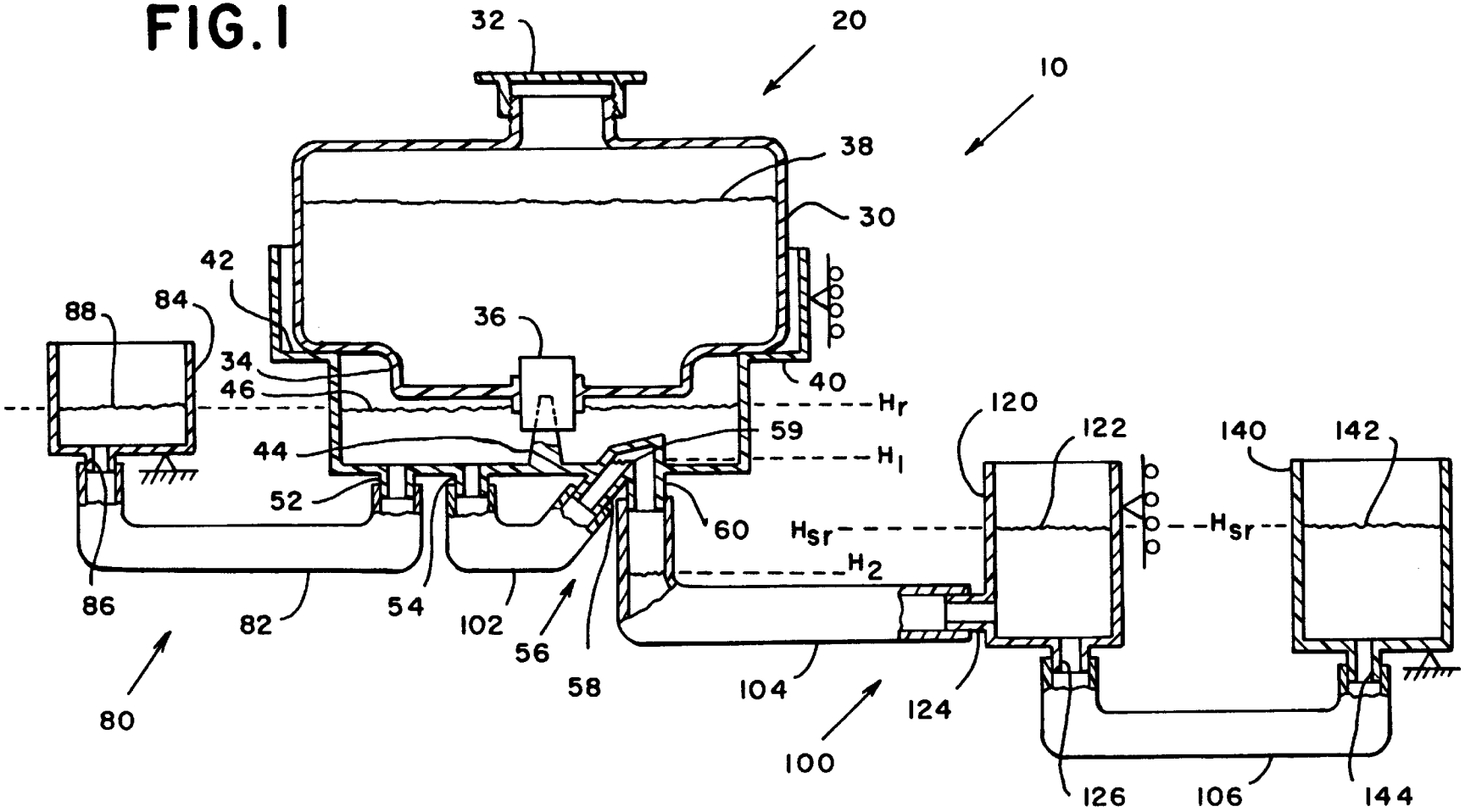
FIG. 1 is a simplified schematic of an elevational cross sectional view of a moistener module in accordance with the present invention.

Referring to FIG. 1, a simplified view a moistener module 10 is shown. For the sake of clarity, only those aspects of the moistener module 10 that are necessary for an understanding of the present invention are shown.

The moistener module 10 includes a reservoir assembly 20, a tape well assembly 80 and an envelope well assembly 100. Additionally, the moistener module 10 includes an applicator assembly (not shown) operatively coupled to both the tape well assembly 80 and the envelope well assembly 100, respectively, for applying water to the tapes and envelopes as the case may be. As used in this application, the term water is intended to include any fluid, such as E-Z Seals® available from Pitney Bowes Inc. of Stamford, Conn., used to wet and soften a gummed (glued) flap of an envelope or gummed surface of a tape.

The reservoir assembly 20 includes a water bottle 30 and a tank 40 where the water bottle 30 is adapted to be removable from the tank 40 and the tank 40 is vertically repositionable by any conventional means (not shown) such as by a slotted bracket (not shown) mounted to a frame (not shown). The water bottle 30 includes a cap 32, a bottom neck portion 34 and a spring loaded rubber stopper 36 fixably mounted to the bottom neck portion 34. An operator (not shown) may supply the bottle 30 with water 38 by removing the cap 32. The tank 40 includes a shelf 42 on which the bottle 30 rests and a plunger 44 that engages the rubber stopper 36 so that the supply water 38 may flow into the tank 40 and create a supply of reservoir water 46. As is known in the art, the height $H_r$ of the reservoir water 46 within the tank 40 remains constant because the supply water 38 flows into the tank 40 as the stopper 36 is exposed to air and stops flowing into the tank 40 as the height $H_r$ of the reservoir water 46 covers the stopper 36.

The tank 40 further includes a tape well outlet 52 operatively coupled with the tape well assembly 80 via a tape hose 82, an envelope well outlet 54 and a trap 56. The envelope well outlet 54 is operatively coupled to the trap 56 via an intermediate hose 102 while the trap 56 is in turn operatively coupled to the envelope well assembly 100 via a secondary reservoir hose 104. The tape well assembly 80 includes a tape well tank 84 having an inlet 86 connected with the tape hose 82. The tape well tank 84 is fixably mounted to any suitable structure (not shown) by conventional means (not shown) and holds a supply of tape well water 88. Those skilled in the art will recognize that the height of the tape well water 88 is equal to the height $H_r$ of the reservoir water 46 because they are directly coupled together. Thus, the height of the tape well water 88 within the tape well tank 84 may be raised or lowered by vertically repositioning the tank 40 eventhough the position of the reservoir water 46 relative to the tank 40 remains constant as described above.

The envelope well assembly 100 includes a secondary reservoir tank 120 vertically repositionable by any conventional means (not shown) such as by a slotted bracket (not shown) mounted to a frame (not shown) and an envelope well tank 140 fixably mounted to any suitable structure (not shown) by conventional means (not shown). The secondary reservoir tank 120 includes a secondary reservoir tank inlet 124 connected to the intermediate hose 104 and a secondary reservoir tank outlet 126 connected to an envelope hose 106. Thus, the envelope hose 106 connects the secondary reservoir tank 120 with the envelope well tank 140 via an envelope well tank inlet 144. The secondary reservoir tank 120 holds a supply of water 122 while the envelope well tank 140 also holds a supply of water 142.

The trap 56 includes a trap inlet 58 operatively coupled with the envelope well outlet 54 via the intermediate hose 102 and a trap outlet 60 operatively coupled with the secondary reservoir tank 120 via the intermediate hose 104. Due to the geometric configuration of the trap 56, a generally inverted V-shaped member, air is captured in the trap 56 and the intermediate hose 104. The height $H_1$ of the water in the trap 56 rises up to a notch 59 within the trap 56 before falling down into the intermediate hose 104 and establishing a height $H_2$ within the intermediate hose 104. Additionally, the secondary reservoir water 122 achieves a height $H_{sr}$ that is duplicated in the envelope well tank 140 by the envelope well water 142 because they are directly coupled together via the envelope hose 106.

With the structure of the moistener module 10 described as above, an overview of the functional and operational characteristics will now be described. Generally, the air captured with the trap 56 creates an air lock that allows the establishment of the height $H_{sr}$ of the secondary reservoir water at a different elevation form the height $H_r$ of the reservoir water. Additionally, the difference in hydrostatic pressure between the height $H_r$ of the reservoir water 46 and the height $H_1$ of the water in the trap 56 is equal to the difference in hydrostatic pressure between the height $H_{sr}$ of the secondary reservoir water 122 and the height $H_2$ of the water in the intermediate hose 104. This is due to the overall moistener module 10 reaching equilibrium and is described in more detail below.

At initial installation, water must be added to the moistener module 10 because the moistener module 10 is shipped dry. To accomplish this, the operator removes the bottle 30 from the moistener module 10 and fills it with water before replacing it. Once placed inside the tank 40, bottle water 38 begins flowing into the tank 40. As described above, reservoir water 46 flows out of the tank 40 via the tape well outlet 52 and the envelope well outlet 54. Since no air is trapped in the tape hose 82, the height or level of the tape well water 88 will reach the height $H_r$ of the reservoir water 46. Thus, as the well water 88 is consumed through use, it is automatically replenished from the reservoir water 46 which is in turn replenished from the bottle water 38.

On the other hand, the envelope well assembly 100 operates differently. At initial installation, reservoir water 46 flows out the envelope well outlet 54, through the intermediate hose 102, around the trap 56 and into the secondary reservoir hose 104. At this point, the secondary reservoir water 122 and the envelope well tank 140 fill via the envelope tank hose 106. Since no air is trapped in the envelope tank hose 106, the height or level of the envelope well water 142 will reach the height $H_{sr}$ of the secondary reservoir water 122. In contrast, air will remain in the secondary reservoir hose 104 since the secondary reservoir tank inlet 124 has a horizontal orientation. Thus, the secondary reservoir water 122 will not cover the inlet 124 until the secondary reservoir water 122 rises to a height above the inlet 124. Once this occurs, air becomes trapped in the secondary reservoir hose 104 and compressed within the secondary reservoir hose 104 so as to offset the difference in hydrostatic pressure created by the difference in hydrostatic pressure between the height $H_r$ of the reservoir water 46 and the height $H_1$ of the water in the trap 56. That is, the difference in hydrostatic pressure between the height $H_r$ of the reservoir water 46 and the height $H_2$ of the water in the trap 56 is equal to the difference in hydrostatic pressure between the height $H_{sr}$ of the secondary reservoir water and the height $H_2$ of the water in the intermediate hose 104. Thus, an air lock is formed that still maintains the capability to allow reservoir water 46 to pass over the notch 59 in the trap 56. Because as envelope well water 142 is consumed, it is replenished by the secondary reservoir water 122 which is in turn replenished from the secondary reservoir hose 104 which results in a decrease in pressure that allows reservoir water 46 to fall over the notch 59 until the pressure again reaches equilibrium.

Those skilled in the art will appreciate that the placement of the various components of the moistener module 10 is dictated by functional constraints and operational considerations of convenience and accessibility. For example, the adjustable components such as the reservoir tank 40 and the secondary reservoir tank 120 must be accessible by the operator. On the other hand, the tape well tank 84 and the envelope well tank 140 are likely required to be located deep within the apparatus of the envelope handling device so as to perform their required tasks of supplying their respective applicators with water. As a result, the tape well tank 84 and the envelope well tank 140 are fixably mounted within an envelope handling device (not shown) according to the nominal dimensions associated with the requirements for the height $H_{sr}$ of the envelope well water 142 and the height $H_r$ of the tape well water 88. Additionally, the tank 40 and the secondary reservoir tank 120 are also mounted within the middle of their respective adjustable ranges according to the nominal dimensions associated with the envelope handling device.

However, due to manufacturing tolerances and differences in sites (for example, a non-level platform for the envelope handling device) where the envelope handling device is installed, some adjustments to the moistener module 10 are likely necessary to optimize the performance of the moistener module 10. Therefore, to raise or lower the level of the tape well water 88, the reservoir tank 40 may be vertically repositioned accordingly. For example, raising the reservoir tank 40 by a fixed amount also raises the level of the tape well water 88 by the fixed amount because the height of the tape well water 88 must remain equal to the height $H_r$ of the reservoir water 46. Importantly, raising the reservoir tank 40 has no effect on the height $H_{sr}$ of the secondary reservoir water 122 and in turn the envelope well water 142. This is because the difference in hydrostatic pressure between the height $H_r$ of the reservoir water 46 and the height $H_1$ of the water in the trap 56 is established by fixed geometry and thus remains constant as the reservoir tank 40 is repositioned. Thus, the air within the trap 56 and the intermediate hose 104 does not realize any pressure change that would trigger a flow of reservoir water 46 over the notch 59. Instead, the air merely shifts position slightly to accommodate the new shape of the secondary reservoir hose 104.

To raise or lower the level of the envelope well water 142, a different approach is used. In this case, vertically repositioning the secondary reservoir tank 120 in an appropriate manner causes the envelope well water 142 to raise or lower accordingly, as the case may be. Here again, the air within the trap 56 and the intermediate hose 104 does not realize any pressure change and again the air merely shifts position slightly to accommodate the new shape of the secondary reservoir hose 104. Since the air within the trap 56 and the intermediate hose 104 does not realize any pressure change, the reservoir water 46 remains unaffected by any repositioning of the secondary reservoir tank 120. Thus, raising or lowering the secondary reservoir tank 120 has no effect on the height $H_r$ of the reservoir water 46 and in turn the tape well water 88.

It should now be apparent to those skilled in the art that the present invention substantially addresses those drawbacks and problems discussed above in the Background. The reservoir water 46 operates as a single source for supply both the tape well water 88 and the envelope well water 142 while they remain independently vertically adjustable.

Importantly, a few details of the preferred embodiment have been found through empirical testing to improve the overall performance of the present invention. One detail is the shape of the trap 56. Generally, it has revealed that it is better to have the upstream side (inlet side) of the notch 59 have a smaller opening than downstream side (outlet side). In this manner, the flow of reservoir water 46 over the notch 59 may be controlled. For example, if reservoir water 46 flows too quickly over the notch 59 into a small opening, then there is a risk that the force of the reservoir water 46 through the intermediate hose 104 will drive all or most of the air out of the system. Thus, a suitable air lock may not form. Therefore, it is preferable to restrict the flow of reservoir water 46 over the notch. On the other hand, if the flow is reduced to a trickle, then the system will be slow to reach equilibrium at initial installation and slow to response to changes. Preferably, the ratio of the cross sectional area on the upstream side of the notch 59 to the cross sectional area on the downstream side of the notch 59 should be in the range of about 0.25 to 0.75.

As another detail, the amount of horizontal slack in the secondary reservoir hose 104 is important to the operation of the moistener module 10. A large horizontal span of slack in the secondary reservoir hose 104 helps the secondary reservoir hose 104 assume a new shape or configuration in response to repositioning of the reservoir tank 40 and/or the secondary reservoir tank 120 with little change in the elevation of the height of the water within the secondary reservoir hose 104. In this manner, it is easier to keep the tape well water 88 and the envelope well water 142 isolated. Preferably, the ratio of horizontal span of the secondary reservoir hose 104 to the vertical span of the secondary reservoir hose 104 should be greater than about 2.0.

Many features of the preferred embodiment represent design choices selected to best exploit the inventive concept as implemented in a mailing machine. However, those skilled in the art will recognize that various modifications can be made without departing from the spirit of the present invention. For example, the secondary reservoir tank 120 is provided merely so that it may be located more conveniently than the envelope well tank 140 to make adjustments easier. Those skilled in the art will recognize that the secondary reservoir tank 120 may serve directly as the envelope well tank 140. Thus, those skilled in the art will readily be able to adapt the inventive concepts of the present invention to suit their own particular applications.

Therefore, the inventive concept in its broader aspects is not limited to the specific details of the preferred embodiments but is defined by the appended claims and their equivalents.

What is claimed is:

1. An envelope handling device including a moistener module, the moistener module comprising:

a reservoir assembling including a reservoir tank for holding a supply of reservoir water having a predetermined height;

a first well tank for holding a supply of first well water, the first well tank directly coupled to the reservoir tank via a first well tank hose so that the reservoir water is capable of flowing through the first well tank hose to the first well tank and raising the first well water to the predetermined height; and a second well tank for holding a supply of second well water at a different height from the predetermined height, the second well tank coupled to the reservoir tank via a second well tank hose and a trap, the trap establishes a pressure differential between the predetermined height and a level of water within the trap; and wherein the reservoir water is capable of flowing through the second well tank hose and the trap to the second well tank and raising the second well water to the different height as air is captured within the trap to balance the pressure differential.

2. The envelope handling device of claim 1 wherein:

the reservoir tank is adjustably mounted to a frame to be repositionable vertically.

3. The envelope handling device of claim 2 wherein:

the trap includes an inlet having a cross sectional area and an outlet having a cross sectional area and a ratio of the inlet cross sectional area to the outlet cross sectional area is with a range of about 0.25 to 0.75.

* * * * *